United States Patent [19]

Glandt et al.

[11] Patent Number: 5,042,579

[45] Date of Patent: Aug. 27, 1991

[54] METHOD AND APPARATUS FOR PRODUCING TAR SAND DEPOSITS CONTAINING CONDUCTIVE LAYERS

[75] Inventors: Carlos A. Glandt; Harold J. Vinegar, both of Houston; John W. Gardner, West University, all of Tex.

[73] Assignee: Shell Oil Company, Houston, Tex.

[21] Appl. No.: 571,393

[22] Filed: Aug. 23, 1990

[51] Int. Cl.[5] ..... E21B 43/24; E21B 43/30

[52] U.S. Cl. ..... 166/248; 166/50; 166/60; 166/245; 166/272

[58] Field of Search ..... 166/50, 60, 65.1, 248, 166/250, 263, 272, 302, 303, 245

[56] References Cited

U.S. PATENT DOCUMENTS

| | | | |
|---|---|---|---|
| Re. 30,738 | 9/1981 | Bridges et al. | 166/248 |
| 3,848,671 | 11/1974 | Kern | 166/248 |
| 3,874,450 | 4/1975 | Kern | 166/65.1 X |
| 3,958,636 | 5/1976 | Perkins | 166/248 |
| 3,986,557 | 10/1976 | Striegler et al. | 166/272 |
| 3,994,340 | 11/1976 | Anderson et al. | 166/272 |
| 4,037,658 | 7/1977 | Anderson | 166/272 |
| 4,085,803 | 4/1978 | Butler | 166/303 |
| 4,116,275 | 9/1978 | Butler et al. | 166/303 |
| 4,344,485 | 8/1982 | Butler | 166/271 |
| 4,456,065 | 6/1984 | Heim et al. | 166/248 |
| 4,489,782 | 12/1984 | Perkins | 166/248 |
| 4,545,435 | 10/1985 | Bridges et al. | 166/65.1 X |
| 4,567,945 | 2/1986 | Segalman | 166/280 X |
| 4,612,988 | 9/1986 | Segalman | 166/248 |
| 4,705,108 | 11/1987 | Little et al. | 166/302 X |
| 4,926,941 | 5/1990 | Glandt et al. | 166/245 X |

OTHER PUBLICATIONS

Towson, "The Electric Preheat Recovery Process," Second International Conference on Heavy Crude and Tar Sand, Caracas, Venezuela, Sep. 1982.

Hiebert et al., "Numerical Simulation Results for the Electrical Heating of Athabasca Oil Sand Formations," *Reservoir Engineering Journal,* SPE Jan. 1986.

*Primary Examiner*—George A. Suchfield

[57] ABSTRACT

An apparatus and method are disclosed for producing thick tar sand deposits by preheating of thin, relatively conductive layers which are a small fraction of the total thickness of a tar sand deposit, with horizontal electrodes. The preheating is continued until the viscosity of the tar in a thin preheated zone adjacent to the conductive layers is reduced sufficiently to allow steam injection into the tar sand deposit. The entire deposit is then produced by steam flooding.

14 Claims, 3 Drawing Sheets

750
800
850
900
950
1000
1050
DEPTH (FT)
0
50
100
150
200
RESISTIVITY (ohm-m)

750
800
850
900
950
1000
1050
DEPTH (FT)
0.0001
0.001
0.01
0.1
1
Kv/Kh 750
800
850
900
950
1000
1050
DEPTH (FT)
0
500
1000
1500
2000
PERMEABILITY (md)

METHOD AND APPARATUS FOR PRODUCING TAR SAND DEPOSITS CONTAINING CONDUCTIVE LAYERS

BACKGROUND OF THE INVENTION

This invention relates to an apparatus and method for the production of hydrocarbons from earth formations, and more particularly, to those hydrocarbon-bearing deposits where the oil viscosity and saturation are so high that sufficient steam injectivity cannot be obtained by current steam injection methods. Most particularly this invention relates to an apparatus and method for the production of hydrocarbons from tar sand deposits containing layers of high electrical conductivity and having vertical hydraulic connectivity between the various geologic sequences.

Reservoirs in many parts of the world are abundant in heavy oil and tar sands. For example, those in Alberta, Canada; Utah and California in the United States; the Orinoco Belt of Venezuela; and the USSR. Such tar sand deposits contain an energy potential estimated to be quite great, with the total world reserve of tar sand deposits estimated to be 2,100 billion barrels of oil, of which about 980 billion are located in Alberta, Canada, and of which 18 billion barrels of oil are present in shallow deposits in the United States.

Conventional recovery of hydrocarbons from heavy oil deposits is generally accomplished by steam injection to swell and lower the viscosity of the crude to the point where it can be pushed toward the production wells. In those reservoirs where steam injectivity is high enough, this is a very efficient means of heating and producing the formation. Unfortunately, a large number of reservoirs contain tar of sufficiently high viscosity and saturation that initial steam injectivity is severely limited, so that even with a number of "huff-and-puff" pressure cycles, very little steam can be injected into the deposit without exceeding the formation fracturing pressure. Most of these tar sand deposits have previously not been capable of economic production.

In steam flooding deposits with low injectivity the major hurdle to production is establishing and maintaining a flow channel between injection and production wells. Several proposals have been made to provide horizontal wells or conduits within a tar sand deposit to deliver hot fluids such as steam into the deposit, thereby heating and reducing the viscosity of the bitumen in tar sands adjacent to the horizontal well or conduit. U.S. Pat. No. 3,986,557 discloses use of such a conduit with a perforated section to allow entry of steam into, and drainage of mobilized tar out of, the tar sand deposit. U.S. Pat. Nos. 3,994,340 and 4,037,658 disclose use of such conduits or wells simply to heat an adjacent portion of deposit, thereby allowing injection of steam into the mobilized portions of the tar sand deposit.

Several prior art proposals designed to overcome the steam injectivity problem have been made for various means of electrical or electromagnetic heating of tar sands. One category of such proposals has involved the placement of electrodes in conventional injection and production wells between which an electric current is passed to heat the formation and mobilize the tar. This concept is disclosed in U.S. Pat. Nos. 3,848,671 and 3,958,636. A similar concept has been presented by Towson at the Second International Conference on Heavy Crude and Tar Sand (UNITAR/UNDP Information Center, Caracas, Venezuela, Sept. 1982). A novel variation, employing aquifers above and below a viscous hydrocarbon-bearing formation, is disclosed in U.S. Pat. No. 4,612,988. In U.S. Pat. No. Re. 30738, Bridges and Taflove disclose a system and method for in-situ heat processing of hydrocarbonaceous earth formations utilizing a plurality of elongated electrodes inserted in the formation and bounding a particular volume of a formation. A radio frequency electrical field is used to dielectrically heat the deposit. The electrode array is designed to generate uniform controlled heating throughout the bounded volume.

In U.S. Pat. No. 4,545,435, Bridges and Taflove again disclose a waveguide structure bounding a particular volume of earth formation. The waveguide is formed of rows of elongated electrodes in a "dense array" defined such that the spacing between rows is greater than the distance between electrodes in a row. In order to prevent vaporization of water at the electrodes, at least two adjacent rows of electrodes are kept at the same potential. The block of the formation between these equipotential rows is not heated electrically and acts as a heat sink for the electrodes. Electrical power is supplied at a relatively low frequency (60 Hz or below) and heating is by electric conduction rather than dielectric displacement currents. The temperature at the electrodes is controlled below the vaporization point of water to maintain an electrically conducting path between the electrodes and the formation. Again, the "dense array" of electrodes is designed to generate relatively uniform heating throughout the bounded volume.

Hiebert et al ("Numerical Simulation Results for the Electrical Heating of Athabasca Oil Sand Formations," Reservoir Engineering Journal, Society of Petroleum Engineers, Jan. 1986) focus on the effect of electrode placement on the electric heating process. They depict the oil or tar sand as a highly resistive material interspersed with conductive water sands and shale layers. Hiebert et al propose to use the adjacent cap and base rocks (relatively thick, conductive water sands and shales) as an extended electrode sandwich to uniformly heat the oil sand formation from above and below.

These examples show that previous proposals have concentrated on achieving substantially uniform heating in a block of a formation so as to avoid overheating selected intervals. The common conception is that it is wasteful and uneconomic to generate nonuniform electric heating in the deposit. The electrode array utilized by prior inventors therefore bounds a particular volume of earth formation in order to achieve this uniform heating. However, the process of uniformly heating a block of tar sands by electrical means is extremely uneconomic. Since conversion of fossil fuel energy to electrical power is only about 38 percent efficient, a significant energy loss occurs in heating an entire tar sand deposit with electrical energy.

Geologic conditions can also hinder heating and production. For example, many formations have little or no vertical hydraulic connectivity within the formation. This means that once the selected layer is preheated, vertical movement of the steam will be somewhat limited, thus limiting vertical transfer of heat to that which can be carried by thermal conduction. However, in other instances, the geologic conditions can actually help production, provided that the recovery method is designed to take advantage of the geologic conditions. In formations in which there is vertical hydraulic connectivity, once steam is injected into a layer, the heated oil progressively drains downwards within the deposit, allowing the steam to rise within the deposit. The steam flowing into the tar sand deposit effectively displaces oil toward the production wells, and provides heat to the formation.

U.S. Pat. No. 4,926,941 (Glandt et al) discloses electrical preheating of a thin layer by contacting the thin layer with a multiplicity of vertical electrodes spaced along the layer.

It is therefore an object of this invention to provide an efficient and economic method of in-situ heat processing of tar sand and other heavy oil deposits having vertical hydraulic connectivity, wherein electrical current is used to heat thin layers within such deposits, utilizing a minimum of electrical energy to prepare the tar sands for production by steam injection; and then to efficiently utilize steam injection to mobilize and recover a substantial portion of the heavy oil and tar contained in the deposit.

SUMMARY OF THE INVENTION

According to this invention there is provided an apparatus for recovering hydrocarbons from tar sand deposits containing a conductive layer and having vertical hydraulic connectivity comprising:

at least one pair of horizontal wells that are horizontal electrodes during an electrical heating stage, and production wells during a production stage, wherein the horizontal electrodes, when electrically excited, span the conductive layer and divide the conductive layer into electrically heated zones and non-electrically heated zones; and at least one injection well wherein all of the injection wells are located in the non-electrically heated zones.

Further according to the invention there is provided a method for recovering hydrocarbons from tar sand deposits containing conductive layers and having vertical hydraulic connectivity comprising:

selection of a thin target conductive layer near a hydrocarbon rich zone and having an electrical conductivity higher that the average of the formation conductivity;

installing at least one pair of horizontal wells that are horizontal electrodes during an electrical heating stage, and are production wells during a production stage, wherein the horizontal electrodes, when electrically excited, span the conductive layer and divide the conductive layer into electrically heated zones and non-electrically heated zones providing at least one injection well for hot fluid injection into the hydrocarbon rich zone wherein all the injection wells are in non-electrically heated zones;

electrically exciting the horizontal electrodes during a heating stage to electrically heat the conductive layer to form a preheated hydrocarbon rich zone immediately adjacent to the thin conductive layer; and recovering hydrocarbons from the production wells.

DETAILED DESCRIPTION OF THE THE INVENTION

Figure 1:
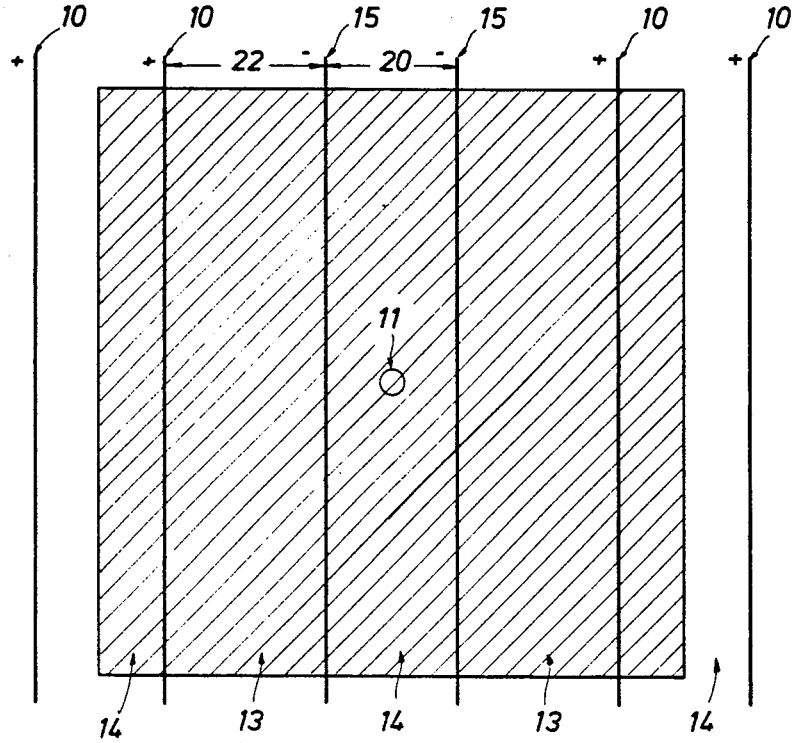
FIG. 1 is a plan view of a well pattern for electrode wells for heating a tar sand deposit, and steam injection and production wells for recovering hydrocarbons from the deposit.

Although this invention may be used in any formation, it is particularly applicable to deposits of heavy oil, such as tar sands, which have vertical hydraulic connectivity and which contain thin high conductivity layers.

A thin high conductivity layer is selected as the heating target. The target layer is generally selected such that it has an electrical conductivity that is higher that the average of the formation conductivity. The thin high conductivity target layers will typically be laterally discontinuous shale layers interspersed within the tar sand deposit, but may also be water sands (with or without salinity differentials), or layers which also contain hydrocarbons but have significantly greater porosity. For geological reasons shale layers are almost always found within a tar sand deposit because the tar sands were deposited as alluvial fill within the shale. The shales have conductivities of from about 0.2 to about 0.5 mho/m, while the tar sands have conductivities of about 0.02 to 0.05 mho/m. Consequently, conductivity ratios between the shales and the tar sands range from about 10:1 to about 100:1, and a typical conductivity ratio is about 20:1. The thin high conductivity target layers chosen for electrical heating are preferably near a hydrocarbon rich layer. Preferably the layer chosen is adjacent to and most preferably adjacent to and below the hydrocarbon rich layer. To compare layers to determine their relative hydrocarbon richness the product of the oil saturation of the layer ($S_o$), porosity of the layer, phi ($\phi$), and the thickness of the layer is used. Most preferably, a conductive layer near the richest hydrocarbon layer is selected.

If the conductive layer is a shale, the horizontal well is drilled in the sand immediately above the thin conductive shale. This is because the horizontal well must also function as a production well, and shales have very low permeability. If the conductive layer is a water sand, the horizontal well can be drilled within the conductive water sand, or immediately above the thin conductive layer.

The thin target conductive layers selected are preferably near the bottom of a thick segment of tar sand deposit, so that steam can rise up through the deposit and heated oil can drain down into the wells. The thin conductive layers to be heated are preferably additionally selected, on the basis of resistivity well logs, to provide lateral continuity of conductivity. However, it is not an essential ingredient of this invention that the layers be laterally continuous. The layers are also preferably selected to provide a substantially higher conductivity-thickness product than surrounding zones in the deposit, where the conductivity-thickness product is defined as, for example, the product of the electrical conductivity for a thin layer and the thickness of that layer, or the electrical conductivity of a tar sand deposit and the thickness of that deposit. By selectively heating a thin layer with a higher conductivity-thickness product than that of the tar sand layer the heat generated within the thin layer is more effectively confined to that thin layer. This is possible because in a tar sand deposit the shale is more conductive than the tar sand, and may be, for example, 20 times more conductive. Thin conductive layers selected on this basis will substantially confine the heat generation within and around the conductive layers and allow much greater spacing between electrodes. The invention would still be operable in a relatively uniform electrical conductivity medium but the spacing between wells would necessarily be shorter.

The horizontal well in this invention will double as a production well during the production stage and a horizontal electrode during the electrical heating stage. This is generally accomplished by using a horizontal well, and converting it to double as a horizontal electrode by using conductive well casing or cement, and exciting it with an electrical current. For example, electrically conductive Portland cement with high salt content or graphite filler, aluminum-filled electrically conductive epoxy, or saturated brine electrolyte, which serves to physically enlarge the effective diameter of the electrode and reduce overheating. As another alternative, the conductive cement between the electrode and the formation may be filled with metal filler to further improve conductivity. In still another alternative, the electrode may include metal fins, coiled wire, or coiled foil which may be connected to a conductive liner and connected to the sand. The effective conductivity of the electrically conductive section should be substantially greater than that of the adjacent deposit layers to reduce local heating at the electrode. The vertical run of the well is generally made non-conductive with the formation by use of a non-conductive cement.

The injection well of the present invention may be a vertical or horizontal well. Where a horizontal injector is used it is oriented generally parallel to the horizontal production wells.

In the present invention, the electrodes are utilized in pairs. The electric potentials are such that current will travel between the two electrodes of a pair only, and not between non-paired electrodes. The pairs of electrodes are generally in a plane at or near in depth to the target layer. The electrodes are generally positioned to span the high conductivity layer. Span as used herein means that as current passes between paired electrodes, at least a portion of the current travel path will be through the target high conductivity layer. Preferrably, the paired electrodes will be located adjacent to or at least partially touching the target layer so that most of the current travel path is through the conductive layer, to maximize the application of electrical energy to the conductive layer. If the high conductivity layer is a shale, the horizontal electrodes should be positioned immediately above the shale, and not in the shale, because shales have very low permeability. The horizontal electrodes are positioned so that the electrodes are generally parallel to each other.

The electric potential of the electrodes is such to induce current flow between the electrodes. For each pair of electrodes there is an electrical potential between the electrodes. Although the pairs of electrodes do not have to all be excited the same, it is generally the case that they will be because the potentials are generally supplied from one source. For any electrode pair one of the electrodes may be at ground potential and the other at an excited (either positively or negatively excited) potential, or both electrodes could be a different positive or negative potentials, or one electrode may be positively excited and the other negatively excited. Of course with the application of alternating current (AC), the polarity of the excited state of the electrode will be alternating constantly.

The electrode well pattern will be determined by an economic optimum which depends, in turn, on the cost of the electrode wells and the conductivity ratio between the thin conductive layer and the bulk of the tar sand deposit. Between each of the paired electrodes, there is an electrically heated zone. Each pair of electrodes is spaced apart from the neighboring pairs of electrodes to allow for a cool zone between the neighboring pairs of electrodes. The cool zone serves as a heat sink to prevent the electrodes from overheating. The electric potentials on the electrodes are arranged such that there is no current flow between neighboring pairs of electrodes. This zone is heated only by thermal conduction. Preferably the adjacent electrodes between different electrode pairs will have similar electrical potential. For example, for electrodes in a field a typical repeating pattern of charges on the electrodes will be:

| | | |
|---|---|---|
| (+) | (−) (−) | (+), |
| (+) | (++) (++) | (+), |
| (−) | (−−) (−−) | (−), |
| (+) | (0) (0) | (+), or |
| (0) | (−) (−) | (0), |

wherein (+), (−), (++), (−−), is a positive AC potential, a negative AC potential, a more positive AC potential, and a more negative AC potential respectively at a given instance in time. It is understood that with AC current the electrodes will be alternating potentials, so in the above illustration, those potentials will be alternating signs at the frequency of the supplied current.

Electrode patterns as shown above will create a cool or non-electrically heated zone between the adjacent electrodes of similar electric potential. The cool zone between the electrodes provides a heat sink to prevent overheating at the electrodes.

Power is generally supplied from a surface power source. Almost any frequency of electrical power may be used. Preferably, commonly available low-frequency electrical power, about 60 Hz, is preferred since it is readily available and probably more economic.

As the thin high conductivity layers are electrically heated, the conductivity of the layers will increase. This concentrates heating in those layers. In fact, for shallow deposits the conductivity may increase by as much as a factor of three when the temperature of the deposit increases from 20° C. to 100° C. For deeper deposits, where the water vaporization temperature is higher due to increased fluid pressure, the increase in conductivity can be even greater. As a result, the thin high conductivity layers heat rapidly, with relatively little electric heating of the majority of the tar sand deposit. The tar sands adjacent to the thin layers of high conductivity are then heated by thermal conduction from the electrically heated shale layers in a short period of time, forming a preheated zone immediately adjacent to each thin conductive layer. As a result of preheating, the viscosity of the tar in the preheated zone is reduced, and therefore the preheated zone has increased injectivity. The total preheating phase is completed in a relatively short period of time, preferably no more than about two years, and is then followed by injection of steam and/or other fluids. Our numerical simulations show that if the horizontal electrodes are immediately above the shale, much of the current will still be concentrated in the shale.

A pattern of production wells (doubling as horizontal electrodes) and steam injection wells is installed in the tar sand deposit. Since the horizontal wells double as horizontal electrodes and horizontal production wells, it is not preferable to simultaneously steam soak with the horizontal wells while electrically heating because the wells will be electrified. If precautions are taken to insulate the surface facilities, however, the wells could be steam soaked while electrically preheating.

Once sufficient oil mobility is established, the electrical heating is discontinued. The preheated zone is then produced by conventional injection techniques, i.e. injecting fluids into the formation through the injection wells and producing through the production wells.

While the formation is being electrically heated, surface measurements are made of the current flow into each electrode. Generally all of the electrodes are energized from a common voltage source, so that as the thin high conductivity layers heat and become more conductive, the current will steadily increase. Measurements of the current entering the electrodes can be used to monitor the progress of the preheating process. The electrode current will increase steadily until vaporization of water occurs at the electrode, at which time a drop in current will be observed. Additionally, temperature monitoring wells and/or numerical simulations may be used to determine the optimum time to commence steam injection. The preheating phase should be completed within a short period of time. In this time, thermal conduction will establish relatively uniform heating in a preheated zone adjacent to the thin conductive layers.

Once the preheating phase is completed, electrical heating is discontinued and the tar sand deposit is steam flooded to recover hydrocarbons present. Fluids other than steam, such as hot air or other gases, or hot water, may also be used to mobilize the hydrocarbons, and/or to drive the hydrocarbons to production wells.

The subsequent continuous steam injection phase begins with continuous steam injection within the thin preheated zone and adjacent to the conductive shale layer where the tar viscosity is lowest. Steam is initially injected adjacent to a shale layer and within the preheated zone. The steam flowing into the tar sand deposit effectively displaces oil toward the production wells. The steam injection and recovery phase of the process may take a number of years to complete. The existence of vertical communication encourages the transfer of heat vertically in the formation during the steam injection phase.

EXAMPLE

Numerical simulations were used to evaluate the feasibility of electrically preheating a thin, conductive layer within a tar sand deposit, and subsequently injecting steam. The numerical simulations required an input function of electrical conductivity versus temperature.

The change in electrical conductivity of a typical Athabasca tar sand with temperature may be described by the equation:

$$C/(T+22°)=\text{constant}$$

where C is the electrical conductivity and T is the temperature in degrees Centigrade. Thus there is an increase in conductivity by about a factor of three as the temperature rises from 20° C. (T+22°=42°) to 100° C. (T+22°=122°). These simulations also required an input function of viscosity versus temperature. For example, the viscosity at 15° C. is about 1.26 million cp, whereas the viscosity at 105° C. is reduced to about 193.9 cp. In a sand with a permeability of 3 darcies, steam at typical field conditions can be injected continuously once the viscosity of the tar is reduced to about 10,000 cp, which occurs at a temperature of about 50° C. Also, where initial injectivity is limited, a few "huff-and-puff" steam injection cycles at the injector may be sufficient to overcome localized high viscosity.

The amount of electrical power generated in a volume of material, such as a subterranean, hydrocarbon-bearing deposit, is given by the expression:

$$P=CE^2$$

where P is the power generated, C is the conductivity, and E is the electric field intensity. For constant potential boundary conditions, such as those maintained at the electrodes, the electric field distribution is set by the geometry of the electrode array. The heating is then determined by the conductivity distribution of the deposit. The more conductive layers in the deposit will heat more rapidly. Moreover, as the temperature of a layer rises, the conductivity of that layer increases, so that the conductive layers will absorb heat still more rapidly than the surrounding layers. This continues until vaporization of water occurs in the conductive layer, at which time its conductivity will decrease as steam evolves from the conductive layer. Consequently, it is preferred to keep the temperature within the conductive layer below the boiling point at reservoir pressure.

FIG. 1 shows a typical configuration of the present invention and is a plan view of a well pattern for the steam injection well and the horizontal wells that double as horizontal electrodes and production wells. The configuration shown in FIG. 1 is used as a model in the following computer simulation. The positively excited horizontal electrodes (10) and the negatively excited horizontal electrodes (15) are arranged in a repeating pattern of (+) (−) (−) (+). Distances (22) and (20) are the distances between paired electrodes, and between non-paired electrodes respectively. Well (11) is an injector well. Zones (13) and (14) are electrically heated and non-electrically heated zones respectively. Of course, the horizontal electrodes (10) and (15) will double as producer wells during the production stage.

FIGS. 2 through 7 show the reservoir properties as a function of depth for the simulated reservoir. A uniform conductivity profile without a thin high conductivity layer was adopted in the example to demonstrate the applicability of the concept under the most unfavorable conditions. The use of thin high conductivity layers, preferably near the bottom of the reservoir, would allow for larger inter-electrode distances and more effective well utilization. In this example the horizontal electrodes were placed at a depth of 970 feet.

Figure 8:
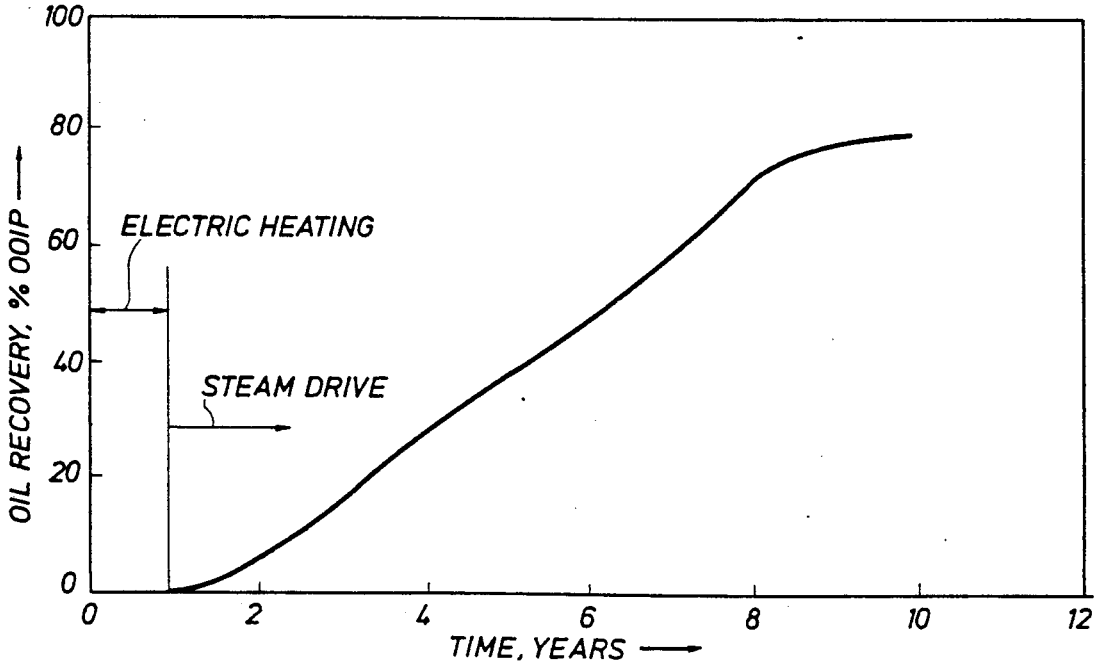
FIG. 8 shows the recovery of the original oil in place (OOIP) of the reservoir as a function of time.
Figure 4:
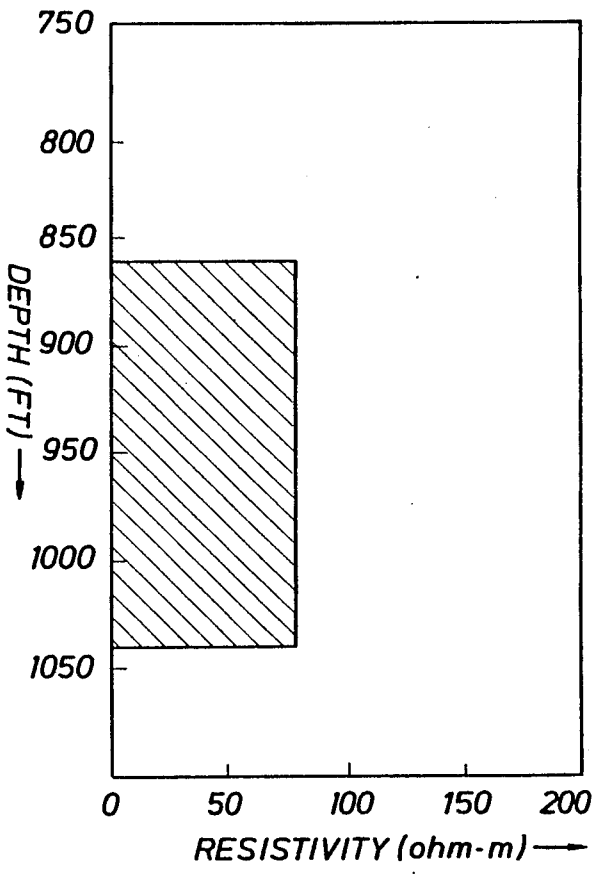
FIG. 4 shows resistivity of a simulated reservoir as a function of depth.
Figure 3:
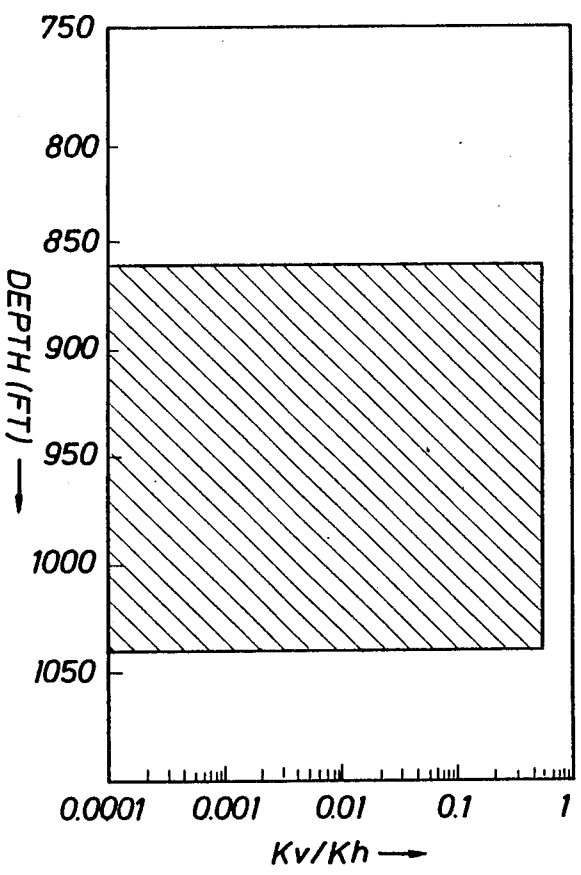
FIG. 3 shows Kv/Kh of a simulated reservoir as a function of depth.
Figure 2:
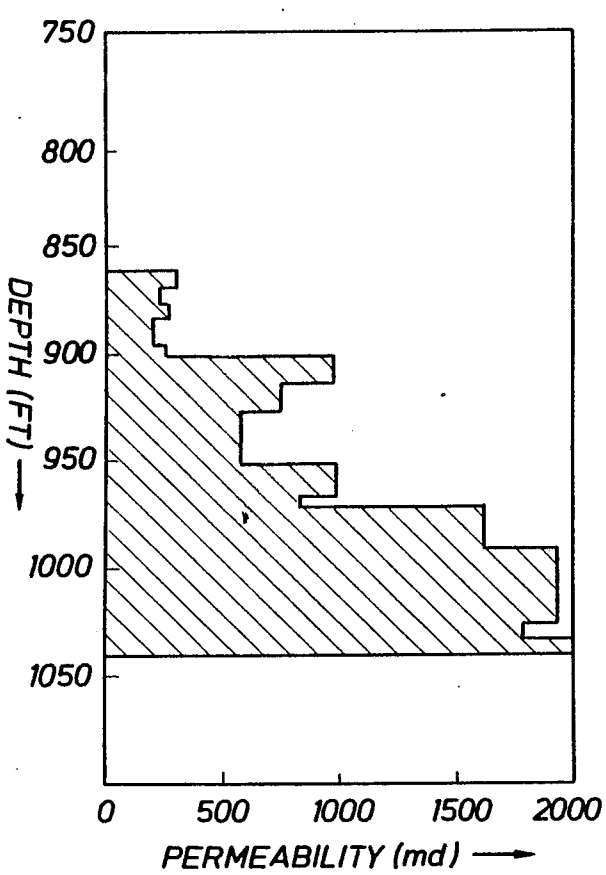
FIG. 2 shows permeability of a simulated reservior as a function of depth.
Figure 7:
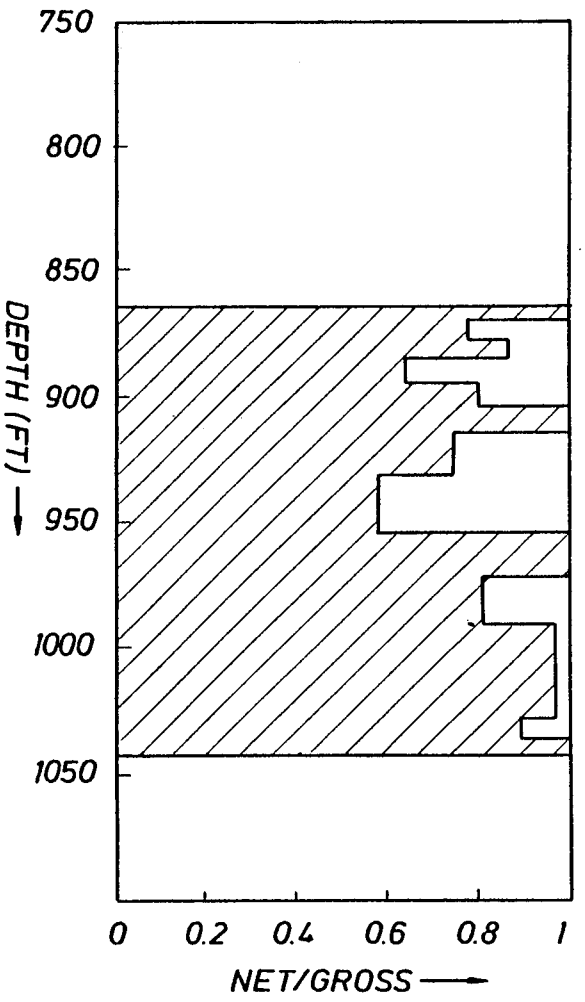
FIG. 7 shows Net/Gross of a simulated reservoir as a function of depth.
Figure 6:
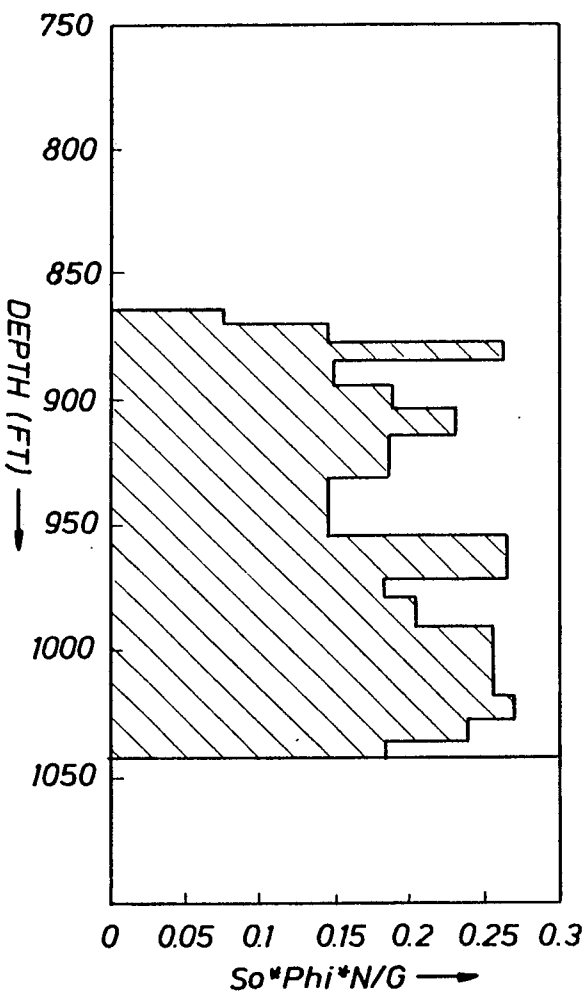
FIG. 6 shows So*phi*N/G of a simulated reservoir as a function of depth.
Figure 5:
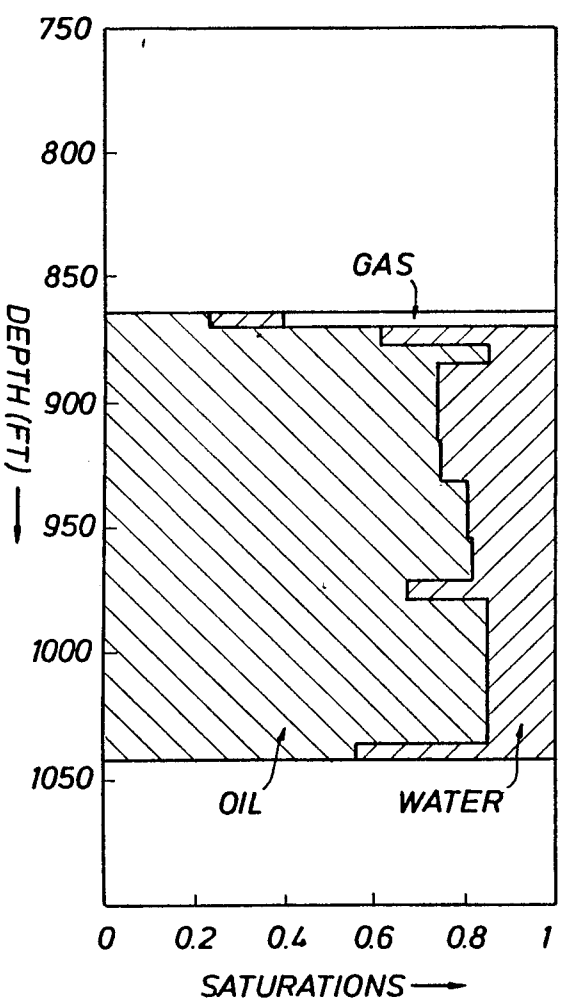
FIG. 5 shows saturation of a simulated reservoir as a function of depth.

FIG. 8 shows the fraction recovery of the original oil in place (OOIP) of the reservoir as a function of time.

The parameters set for the electric preheating numerical simulation are listed in Table 1.

TABLE 1

| | |
|---|---|
| Horizontal electrode drilled at depth, ft | 970 |
| Interelectrode distance | |
| non-paired, ft | 80 |
| paired, ft | 100 |
| Electrode diameter, in | 9.875 |
| Applied voltage, volts | 550 |
| Max current per unit of well length, amp/ft | 2.7 |
| Heating time, years | 1 |
| Max electrode temp., °F. | 545 |
| Heat injection, kW-hr/bbl original oil in place | 8.2 |

In the simulation the electric heating was conducted for about one year, followed by a steam drive. FIG. 8 shows that recoveries flatten out after about eight to ten years of production.

The oil recovery and steam injection rates for a five-acre pattern using the proposed process are more akin to conventional heavy oil developments than to tar sands with no steam injectivity. The total electrical energy utilized was less than 10 percent of the equivalent energy in steam utilized in producing the deposit; thus, the ratio of electrical energy to steam energy was very favorable. Also, the economics of the process is significantly improved relative to the prior art proposals of uniform electrical heating of an entire tar sand deposit.

Significant energy savings can be realized when the electrodes are immediately above and span a thin conductive layer such as a shale layer within a tar and deposit. Preheating a thin conductive layer substantially confines the electrical current in the vertical direction, minimizes the amount of expensive electrical energy dissipated outside the tar and deposit, and provides a preheated zone of reduced viscosity within the tar sand deposit that allows subsequent steam injection.

Having discussed the invention with reference to certain of its preferred embodiments, it is pointed out that the embodiments discussed are illustrative rather than limiting in nature, and that many variations and modifications are possible within the scope of the invention. The process could also be applied in other hydrocarbon bearing deposits than tar sands. Many such variations and modifications may be considered obvious and desirable to those skilled in the art based upon a review of the figures and the foregoing description of preferred embodiments.

What is claimed is:

1. A process for recovering hydrocarbons from tar sand deposits containing high conductivity layers and a hydrocarbon rich zone comprising:

selecting a thin high conductivity target layer near the hydrocarbon rich zone;

installing at least one pair of horizontal production wells that are horizontal electrodes during an electrical heating stage, and are production wells during a production stage, wherein the horizontal electrodes, when electrically excited, span the high conductivity target layer and divide the target layer into electrically heated zones and non-electrically heated zones;

providing at least one injection well for hot fluid injection into the hydrocarbon rich zone;

electrically exciting the horizontal electrodes during the electrical heating stage to electrically heat the high conductivity target layer to form a thin preheated hydrocarbon rich zone immediately adjacent to the target layer;

injecting a hot fluid into the deposit adjacent to the high conductivity target layer and within the thin preheated hydrocarbon rich zone to displace the hydrocarbons to the production wells; and recovering hydrocarbons from the production wells.

2. The process of claim 1 wherein the hot fluid is steam.

3. The process of claim 1 wherein the hot fluid is hot water.

4. The process of claim 1 wherein the injection well is located in the non-electrically heated zone;

5. A process for recovering hydrocarbons from tar sand deposits containing high conductivity layers and a hydrocarbon rich zone comprising:

selecting a thin high conductivity target layer near the hydrocarbon rich zone;

installing at least one pair of horizontal production wells that are horizontal electrodes during an electrical heating stage, and are production wells during a production stage, wherein the horizontal electrodes, when electrically excited, span the high conductivity target layer and divide the high conductivity layer into electrically heated zones and non-electrically heated zones;

providing at least one injection well for hot fluid injection into the hydrocarbon rich zone;

electrically exciting the horizontal electrodes during the electrical heating stage to electrically heat the high conductivity target layer to form a thin preheated hydrocarbon rich zone immediately adjacent to the high conductivity target layer;

injecting a hot fluid into the thin preheated hydrocarbon rich zone to increase the injectivity of the preheated zone;

injecting a drive fluid into the deposit to drive the hydrocarbons to the production wells; and recovering hydrocarbons from the production wells.

6. The process of claim 5 wherein the hot fluid is steam.

7. The process of claim 5 wherein the drive fluid is steam.

8. The process of claim 5 wherein the drive fluid is hot water.

9. The process of claim 5 wherein the injection well is located in the non-electrically heated zone;

10. A process for recovering hydrocarbons from tar sand deposits containing high conductivity layers and a hydrocarbon rich zone comprising:

selecting a thin high conductivity target layer near the hydrocarbon rich zone;

installing at least one pair of horizontal wells that are horizontal electrodes during an electrical heating stage, and are production wells during a production stage, wherein the horizontal electrodes, when electrically excited, span the high conductivity target layer and divide the target layer into electrically heated zones and non-electrically heated zones;

providing at least one injection well for steam injection into the hydrocarbon rich zone;

electrically exciting the horizontal electrodes during the electrical heating stage to electrically heat the high conductivity target layer to form a preheated hydrocarbon rich zone immediately adjacent to the target layer;

injecting a steam into the deposit adjacent to the high conductivity target layer and within the preheated zone to displace the hydrocarbons to the production wells; and recovering hydrocarbons from the production wells.

11. The process of claim 10 wherein the injection well is located in the non-electrically heated zone;

12. A process for improving the injectivity of a hydrocarbon deposit containing high conductivity layers and a hydrocarbon rich zone comprising:

selecting a thin high conductivity target layer near the hydrocarbon rich zone;

installing at least one pair of horizontal electrodes that when electrically excited, span the high conductivity target layer and divide the target layer into electrically heated zones and non-electrically heated zones;

providing at least one injection well in the non-electrically heated zone for hot fluid injection into the hydrocarbon rich zone; and electrically exciting the horizontal electrodes during a heating stage to electrically heat the conductive layer to form a preheated hydrocarbon rich zone immediately adjacent to the target layer.

13. The process of claim 12 wherein the hot fluid is steam.

14. The process of claim 13 wherein the hot fluid is hot water.

* * * * *